US005413271A

United States Patent [19]

Mansbridge et al.

[11] Patent Number: 5,413,271

[45] Date of Patent: May 9, 1995

[54] FORMING OF METAL ARTICLES

[75] Inventors: Martin H. Mansbridge; David Irwin, both of Bristol, England

[73] Assignee: British Aerospace Public Limited Company, Hampshire, United Kingdom

[21] Appl. No.: 202,115

[22] Filed: Feb. 25, 1994

[30] Foreign Application Priority Data

Feb. 27, 1993 [GB] United Kingdom ..... 9304041

[51] Int. Cl.[6] ..... B23K 28/02

[52] U.S. Cl. ..... 228/157; 228/142; 228/173.6; 228/265

[58] Field of Search ..... 228/157, 173.6, 265, 228/142

[56] References Cited

U.S. PATENT DOCUMENTS

| | | | |
|---|---|---|---|
| 4,460,657 | 7/1984 | Elrod et al. | 428/600 |
| 4,644,626 | 2/1987 | Barnes et al. | 72/63 |
| 4,984,732 | 1/1991 | Hudson et al. | 228/173.2 |
| 4,989,774 | 2/1991 | Stephen et al. | 228/157 |
| 5,277,357 | 1/1994 | Miyamoto et al. | 228/173.6 X |

*Primary Examiner*—Kenneth J. Ramsey
*Attorney, Agent, or Firm*—Nixon & Vanderhye

[57] ABSTRACT

A method of superplastically forming a metal article and an article formed by such a method are provided. The method includes the steps of placing sheet material including at least one sheet of superplastically formable material (2, 3) and a sheet of reinforcing material (10) adjacent a said sheet (2) of superplastically formable material within a mold tool having a male former (18) protruding from the tool surface positioned to contact the sheet of reinforcing material during forming and causing the at least one superplastically formable sheet (2, 3) adjacent the reinforcing sheet (10) to be superplastically formed into conformation with the surface (28) of the mold tool and simultaneously to urge the sheet of reinforcing material (10) against the male former (18). The method is characterised by thinning at least one selected area (14, 15, 16, 17) of the sheet of reinforcing material (10), the at least one area being adapted to form around at least one region of high curvature (19, 20, 21, 22) of the male former (18) whereby to promote controlled folding of the reinforcing sheet (10) about the former.

9 Claims, 5 Drawing Sheets

FORMING OF METAL ARTICLES

BACKGROUND OF THE INVENTION

This invention relates to the forming of metal articles, specifically by the process known as superplastic forming.

Certain metallic alloys exhibit the property, in a certain temperature range and when deformed within a certain range of strain rates, of behaving like a viscous fluid and undergoing large deformations without necking or fracture. This property is normally exploited by applying differential gas pressure to either side of a sheet of superplastically formable material to blow the sheet to the form of a mold tool in which the sheet is placed. Such alloys, when pressed together with sufficient pressure within said temperature range, are also capable of joining together permanently under said pressure. This process is called diffusion bonding.

Hollow stiffened structures may be readily made using two or more sheets of superplastically formable material sealably connected together to form one or more gas-tight envelopes and expanded by pressure of inert gas within the envelope(s) to the shape of an enveloping mold tool.

DESCRIPTION OF THE PRIOR ART

When it is necessary to locally reinforce the structure, for example when two spaced walls of the structure are indented towards one another and joined together for connecting the structure to another member, a sheet of reinforcing material is often inserted within the resulting recess or recesses formed in the outer walls of the structure where the two walls meet evenly to distribute connecting loads throughout the structure.

It is known to form such a structure with a reinforcement during the superplastic forming cycle by placing the sheet of reinforcing material within the mold tool against one of the superplastically formable sheets. The sheets may be connected together by spot welds. The mold tool has a male former projecting from one surface thereof about which the sheet of reinforcing material and superplastically formable sheet will be formed during the superplastic forming process. This former forms the above mentioned recess in the outer wall of the structure. The sheet of reinforcing material is urged into position around the male former by action of the superplastic deformation of the sheet adjacent thereto and is likely to fold up against flat or low curvature regions of the male former without difficulty and to adopt the shape of the former. If this male former has sharp changes of direction (or regions of high curvature) however the sheet of reinforcing material in the regions of high curvature will tend to crease in an uncontrolled manner as it seeks to "lose" part of its area as it folds around the region of high curvature during forming.

This uncontrolled creasing naturally leads to malformation of the structure and hence unpredictability of stress distribution within the structure.

SUMMARY OF THE INVENTION

It is an object of the invention to provide means for ensuring folding of the sheet of reinforcing material in a predetermined manner about regions of high curvature of a male former in the mold tool when the reinforcing material is urged into position by the superplastically forming sheet of material.

According to one aspect of the invention there is provided a method of forming a metal article including the steps of placing sheet material including at least one sheet of superplastically formable material and a sheet of reinforcing material adjacent a said sheet of superplastically formable material within a mold tool having a male former protruding from the tool surface positioned to contact said sheet of reinforcing material during forming and causing the at least one superplastically formable sheet adjacent the reinforcing sheet to be superplastically formed into conformation with the surface of the mold tool and simultaneously to urge the sheet of reinforcing material against the male former, the method being characterised by thinning at least one selected area of the sheet of reinforcing material, said at least one area being adapted to form around at least one region of high curvature of the male former whereby to promote controlled folding of the reinforcing sheet thereabout.

The thinning process in the at least one region of the reinforcing sheet adapted to form around the region or regions of high curvature of the male former tends to concentrate creasing or folding of the material in the thinned area of the sheet and therefore urges the material to form a single fold in this region whose form and direction therefore become predictable and hence controllable.

The method may include the step of attaching the at least one superplastically formable sheet to at least one other sheet prior to the superplastic formation step whereby to form, via the superplastic formation step, a cellular structure for the metal article.

The method may include the step of attaching the or each sheet of reinforcing material to the or each sheet of superplastically formable material prior to said superplastic formation step. The said attachment may be effected by welding which may be conveniently spot welding and may be carried out by electrical resistence welding techniques.

The at least one region of high curvature of the male former may be positioned generally to have an aspect along a line of attachment of the at least one superplastically formable sheet to the at least one other sheet whereby, upon the superplastic formation step taking place, a fold of reinforcing material arising during the folding thereof about said at least one region of high curvature will be caught between two superplastically expanding walls of the cellular structure forming into a web whereby to reinforce a root region of the web adjacent the male former.

The sheet of reinforcing material may be attached to the at least one sheet of superplastically formable material along said line of attachment of the latter to the at least one other sheet of material.

The said line of attachment may be formed to substantially bisect said thinned area of the sheet of reinforcing material.

The male former may be a quadrilateral having corner regions of high curvature orientated to have an aspect along four said lines of attachment whereby to form a "skin" therearound connecting four web root regions of the cellular structure.

According to a second aspect of the invention there is provided a metal article formed according to the method of the first aspect of the invention.

BRIEF DESCRIPTION OF THE DRAWINGS

The invention will now be described by way of example with reference to the accompanying drawings of which.

DETAILED DESCRIPTION

Figure 1:
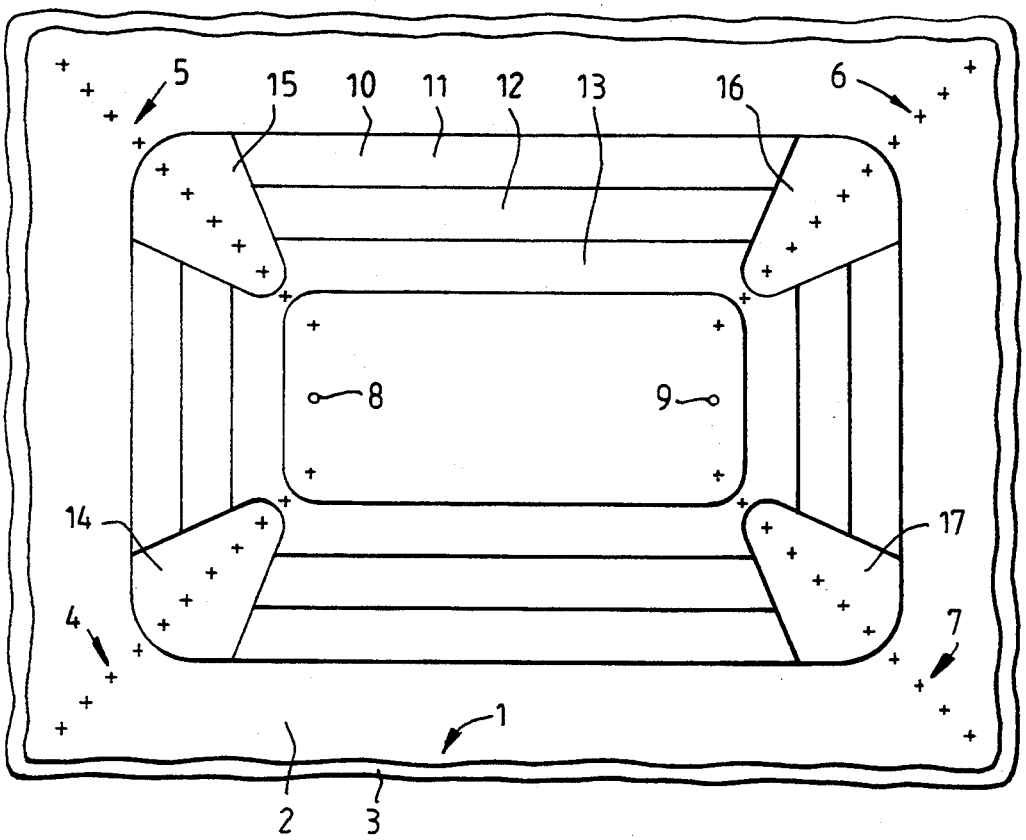
FIG. 1 is a plan view of a stack of sheets for superplastic formation according to the method of the invention.

Referring to the drawings, FIG. 1 illustrates how a stack of sheets 1 is arranged prior to placement in a mold tool for forming. The stack 1 comprises a pair of core sheets 2, 3 spot welded together along lines 4, 5, 6, 7 of spot welds. Spot welded at points 8, 9 to the core sheets 2, 3 is a presculpted reinforcing sheet 10. This reinforcing sheet has three graduated thickness regions 11, 12, 13 parallel with the four edges thereof and also four thinned corner regions 14, 15, 16, 17. The sculpting may be carried out by any known method, here chemical etching has been used. It will be noted that the four lines of spot welds 4, 5, 6, 7 substantially bisect the thinned corner regions 14, 15, 16, 17 of the reinforcing sheet 10 for reasons to be explained later.

FIGS. 2, 3, 4, 5 and 6 show various stages of formation of a cellular structure about a male former 18. The male former 18 has corner regions of high curvature 19, 20, 21, 22 connected by flat sides 23, 24, 25, 26. The male former also has an inner flat surface 27 adapted to contact the reinforcing sheet 10 and forms part of a mold tool whose inner surface it projects from.

Figure 2:
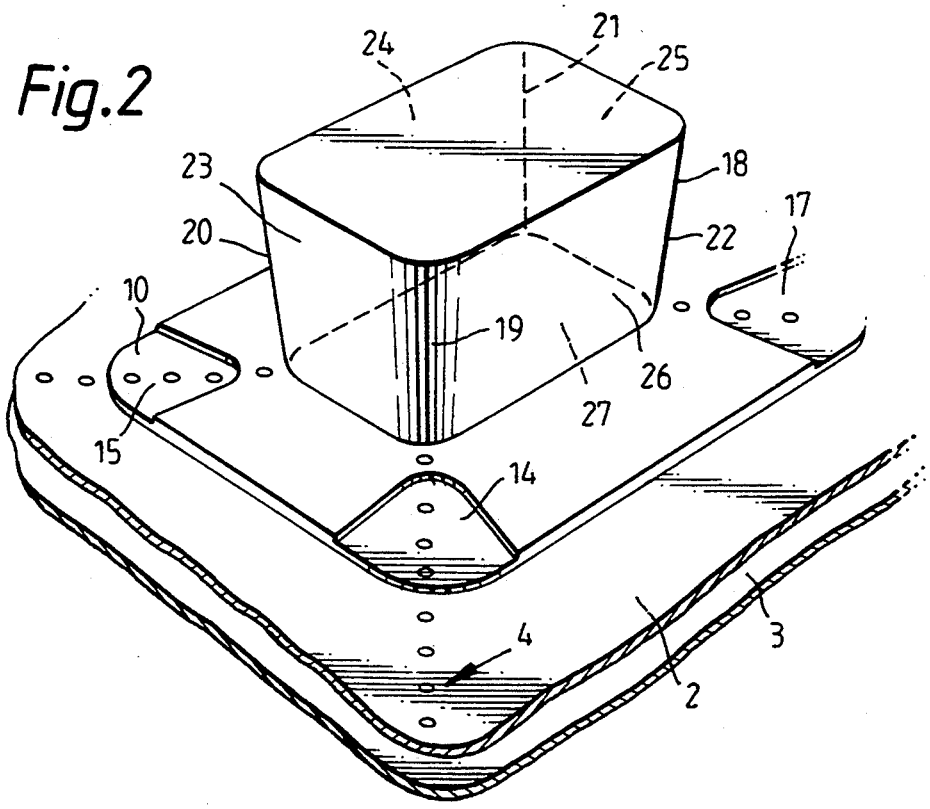
FIG. 2 is a perspective view of superplastically formable core sheets and a reinforcing sheet in contact with a male former protruding from a mold tool prior to formation commencing.

Looking at FIG. 2 it will be seen that the corner region 19 of the male former 18 has an aspect generally along the line of spot welds 4.

Figure 3:
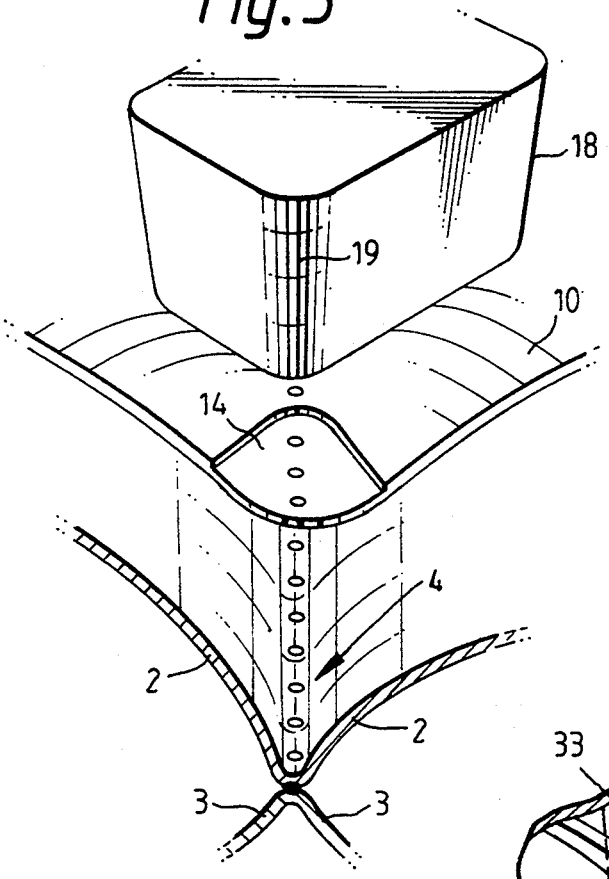
FIG. 3 shows the arrangement of FIG. 2 with initial superplastic forming of the core sheets starting to lift the reinforcing sheet.

In FIG. 3 a gas-tight envelope formed by the core sheets 2 and 3 being welded together around a periphery thereof commences expansion under pressure of inert gas injected between the core sheets. It will be seen that the line of spot welds 4 prevents separation of the core sheets 2 and 3 therealong and forces the core sheets to superplastically deform upwardly either side of the line of welds 4. It can be seen in this figure that the core sheet 2 either side of the line of spot welds 4 is contacting the reinforcing sheet 10 and starting to urge same upwardly.

Figure 4:
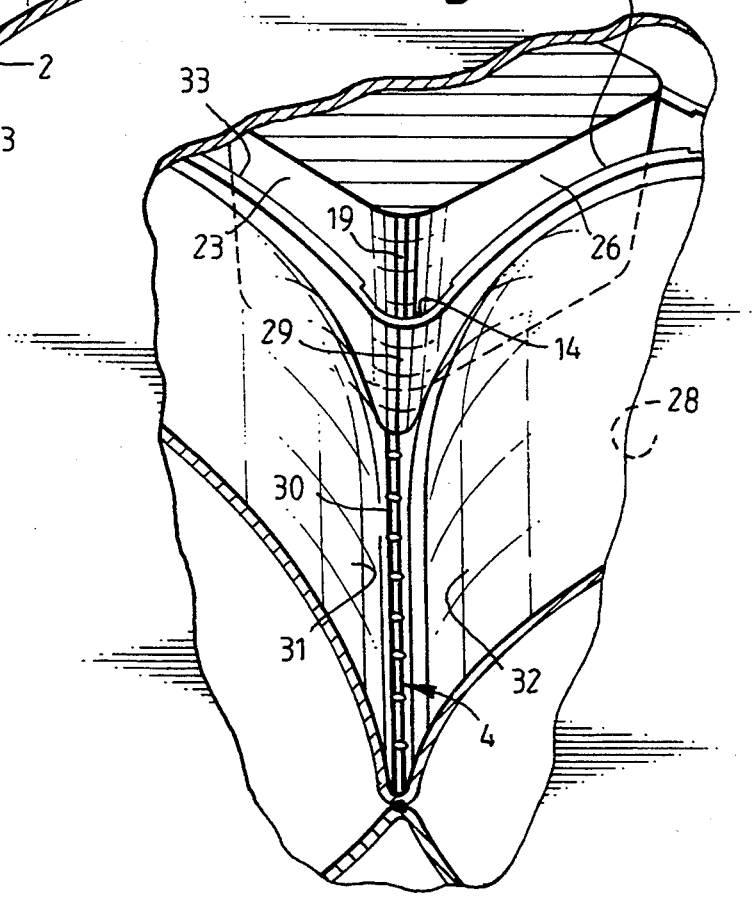
FIG. 4 shows the same arrangement when upper regions of the core sheet touch a surface of the mold tool.

In FIG. 4 the core sheet 2 has deformed upwardly such that upper regions thereof have contacted an upper tool surface 28 and the reinforcing sheet 10 has been urged upwardly about the male former 18. Because of the arrangement of the line of spot welds 4 in relation to the corner region 19 of the male former a fold 29 of excess material of the reinforcing sheet 10 which comprises the thinned corner region 14 thereof has started to bulge outwardly away from the male former and into a V-shaped recess 30 formed between adjacent bulges 31, 32 of the core sheet 2. Side regions 33, 34 of the reinforcing sheet 10 are being urged, without creasing or folding, against flat sides 23, 26, of the male former.

Figure 5:
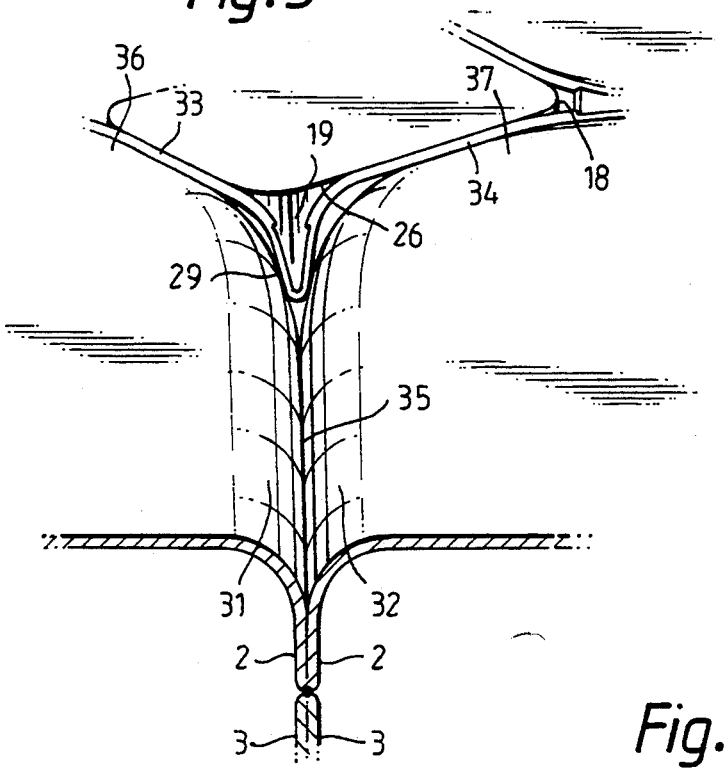
FIG. 5 shows the arrangement when the formation of a web starts to trap a fold of the reinforcing sheet.

FIG. 5 shows the process further advanced in which the adjacent bulges 31, 32 of the core sheet 2 have met along an area of contact 35 and are starting to trap the fold 29 of the reinforcing sheet therebetween. It will be seen in addition that areas of the core sheet 36, 37 adjacent side regions 33, 34 of the reinforcing sheet 10 have urged the side regions fully into contact with the flat sides 23, 26 of the male former.

Figure 6:
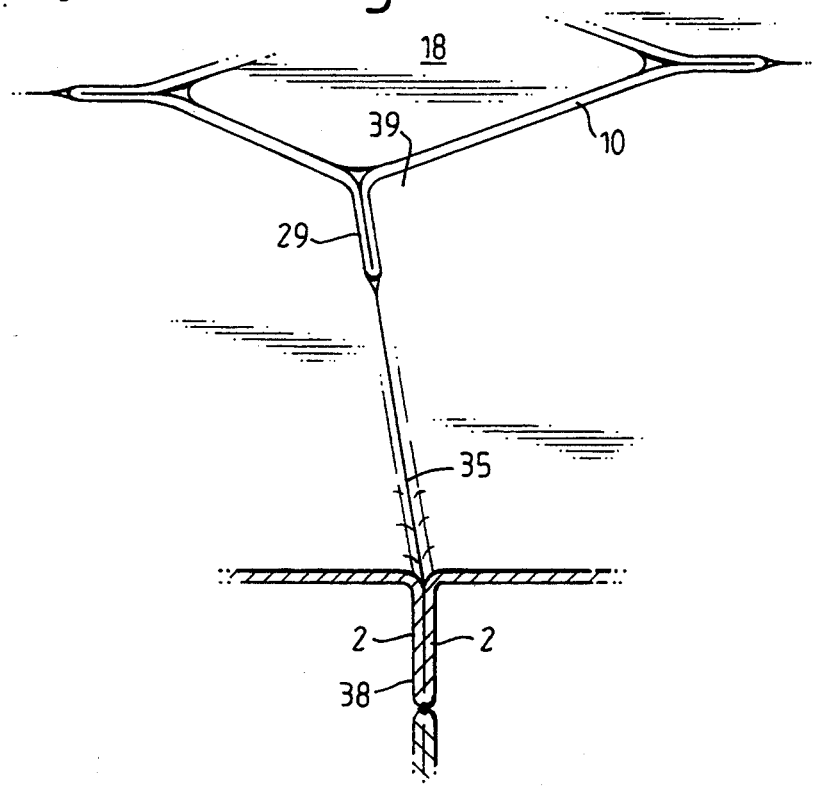
FIG. 6 shows the arrangement in its final form.

In FIG. 6 the structure is fully formed about the male former. The area of contact 35 between the adjacent regions of the core sheet 2 now extends upwardly to the tool surface. A web 38 has now been formed by diffusion bonding of adjacent portions of the core sheet 2 together under gas pressure. The fold 29 of the reinforcing sheet has now been fully trapped within the web 38 to form a reinforcement to a root region 39 of the web. It will be seen that there are no uncontrolled folds or creases in the resulting shape of the reinforcing sheet 10 but that the excess material of the reinforcing sheet comprising the thinned corner region 14 has been formed into a single fold in a predetermined manner to form the root reinforcement of the web 38.

Figure 7:
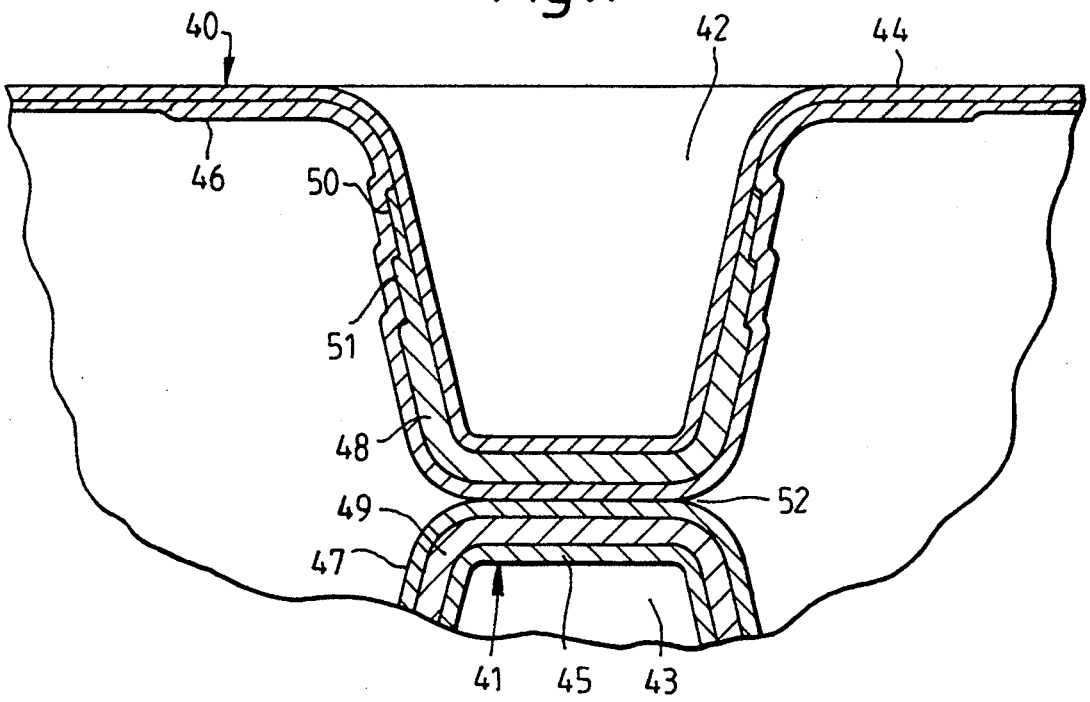
FIG. 7 shows a section through an article formed according to the method of the invention.
Figure 8:
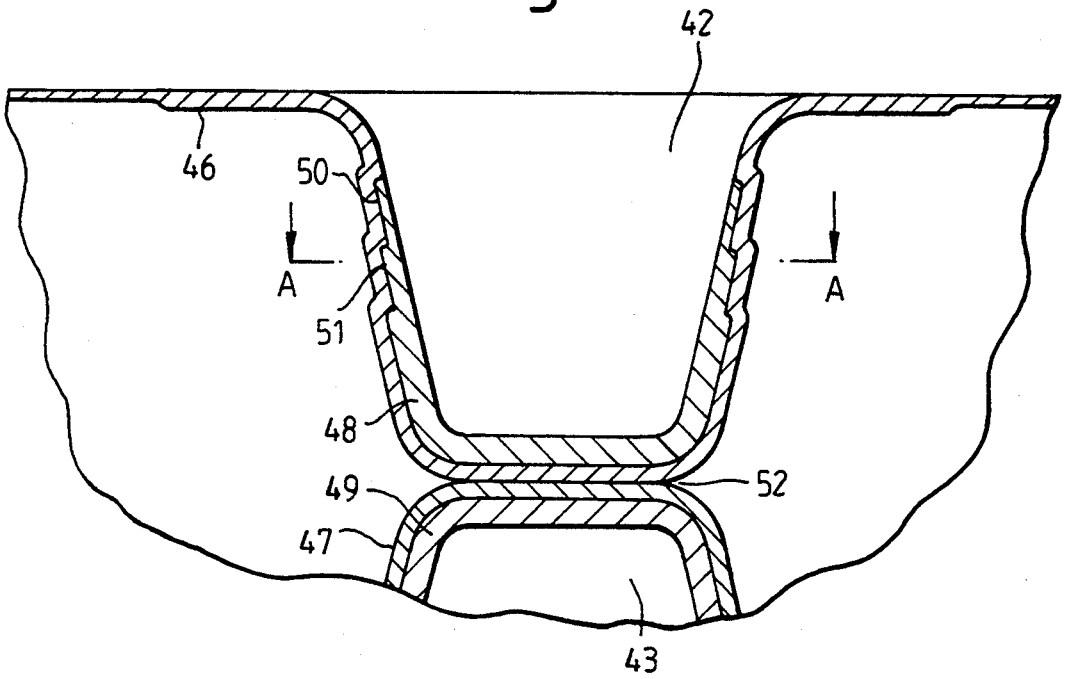
FIG. 8 shows an alternative section through a similar article without a face sheet on either side thereof.
Figure 9:
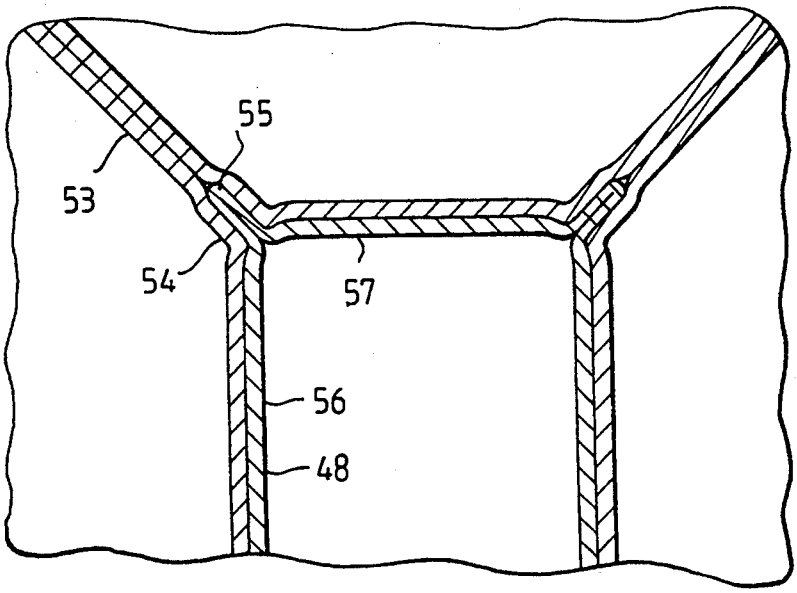
FIG. 9 shows a section taken along the line A—A of FIG. 8.

FIGS. 7, 8 and 9 show three resulting cross-sections from such a process as illustrated in FIGS. 2 to 6. In FIG. 7 instead of just a superplastically formable core sheet and a reinforcing sheet, on either side of the structure, however, an additional face sheet has been employed placed over both core and reinforcing sheets within the mold. This is formed in direct contact with the mold surface and sandwiches the reinforcing sheet with the core sheet. This method is known as a "four sheet blow". The structure shown has a pair of outer skins 40, 41 each of which is formed with a recess 42, 43 in a manner as described above. The resulting structure includes face sheets 44, 45, core sheets 46, 47 and reinforcing sheets 48, 49. It will be appreciated that all these sheets have been diffusion bonded together to form a monolithic structure and no grain boundaries will be visible upon sectioning the structure.

Thinning of the reinforcing sheet 48 can be seen in regions 50, 51 corresponding to graduated thickness regions 11 and 12 in the earlier figures.

The region of joining 52 of the two skins 40, 41 provides a reinforcement suitable for attaching the structure to another structure, for example by through bolting.

FIG. 8 shows the structure of FIG. 7 but without face sheets 44 and 45. FIG. 9, a section on the line A—A of FIG. 8, shows a web 53 reinforced in a root region 54 by the presence of a fold 55 of the reinforcing sheet 48 formed therebetween. Stresses transmitted along each web may therefore be more effectively transferred into walls 56, 57 of the recess.

We claim:

1. A method of forming a metal article including the steps of placing sheet material including at least one sheet of superplastically formable material and a sheet of reinforcing material adjacent a said sheet of superplastically formable material within a mold tool having a male former protruding from the tool surface positioned to contact said sheet of reinforcing material during forming and causing the at least one superplastically formable sheet adjacent the reinforcing sheet to be superplastically formed into conformation with the surface of the mold tool and simultaneously to urge the sheet of reinforcing material against the male former, the method being characterised by thinning at least one selected area of the sheet of reinforcing material, said at least one area being adapted to form around at least one region of high curvature of the male former whereby to promote controlled folding of the reinforcing sheet thereabout.

2. A method as in claim 1 including the step of attaching the at least one superplastically formable sheet to at least one other sheet prior to the superplastic formation step whereby to form, via the superplastic formation step, a cellular structure for the metal article.

3. A method as in claim 1 including the step of attaching the or each sheet of reinforcing material to the or each sheet of superplastically formable material prior to said superplastic formation step.

4. A method as in claim 3 in which the said attachment is effected by welding.

5. A method as in claim 4 in which the welding is spot resistance welding.

6. A method as in claim 2, in which the at least one region of high curvature of the male former may be positioned generally to have an aspect along a line of attachment of the at least one superplastically formable sheet to the at least one other sheet whereby, upon the superplastic formation step taking place, a fold of reinforcing material arising during the folding thereof about said at least one region of high curvature will be caught between two superplastically expanding walls of the cellular structure forming into a web whereby to reinforce a root region of the web adjacent the male former.

7. A method as in claim 6 in which the sheet of reinforcing material is attached to the at least one sheet of superplastically formable material along said line of attachment of the latter to the at least one other sheet of material.

8. A method as in claim 7 in which the said line of attachment is formed to substantially bisect said thinned area of the sheet of reinforcing material.

9. A method as in claim 6 in which the male former is a quadrilateral having corner regions of high curvature orientated to have an aspect along four said lines of attachment whereby to form a skin therearound connecting four web root regions of the cellular structure.

* * * * *